United States Patent [19]

Anderson

[11] Patent Number: 4,961,329

[45] Date of Patent: Oct. 9, 1990

[54] PROTECTIVE PADLOCK HASP FOR USE WITH PADLOCKS HAVING MULTIPLE LENGTH SHACKLES

[75] Inventor: John P. Anderson, Norco, Calif.

[73] Assignee: The Hartwell Corporation, Placentia, Calif.

[21] Appl. No.: 407,966

[22] Filed: Sep. 15, 1989

[51] Int. Cl.[5] ..... E05B 67/38; E05C 19/08

[52] U.S. Cl. ..... 70/2; 70/54

[58] Field of Search ..... 70/2–12, 70/54–56, 417, 63; 292/281–286

[56] References Cited

U.S. PATENT DOCUMENTS

| | | | |
|---|---|---|---|
| 1,248,293 | 11/1917 | Ellington . | |
| 1,690,041 | 6/1925 | Sundquist | 70/38 A |
| 4,576,022 | 3/1986 | Gamble . | |
| 4,745,783 | 5/1988 | Poe | 70/2 |
| 4,781,043 | 11/1988 | Loeffler | 70/54 |
| 4,788,832 | 12/1988 | Poe | 70/2 |

*Primary Examiner*—Robert L. Wolfe

*Attorney, Agent, or Firm*—Fulwider, Patton, Lee & Utecht

[57] ABSTRACT

A protective padlock hasp for receipt of a range of padlocks having different length shackles for connecting adjacent parts together. The device includes a pair of mounting plates having formed integrally therewith one or more protective plates which are arranged to be disposed in confronting relationship with the shackle and are carried from the mounting plate by means of an intermediate web formed with openings for receipt therethrough of the opposite legs of the shackle. The dimensions of the shield plate is such that it extends downwardly to the body of the padlock and upwardly to the level of the closed horseshoe shaped end of the shackle to thus block access to such shackle by bolt cutters or the like. One or more spacer devices are provided for nesting against one of the mounting plates and are formed with a spacer leg to be disposed under the web and project downwardly into butting engagement with the top of the padlock body to block travel thereof upwardly toward the web.

4 Claims, 3 Drawing Sheets

FIG. 1
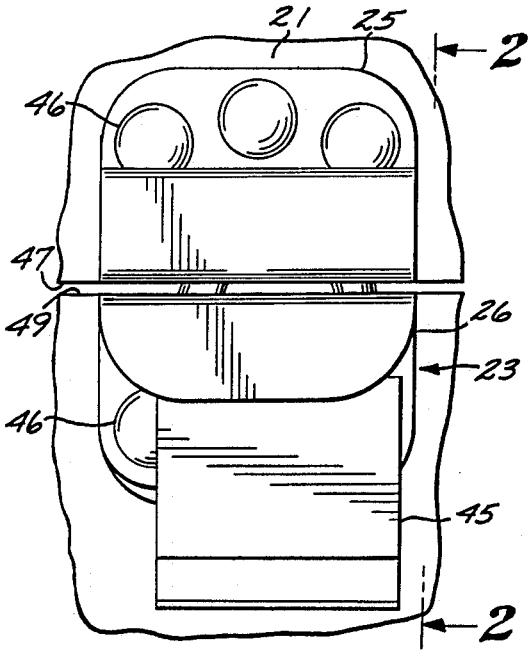
FIG. 2
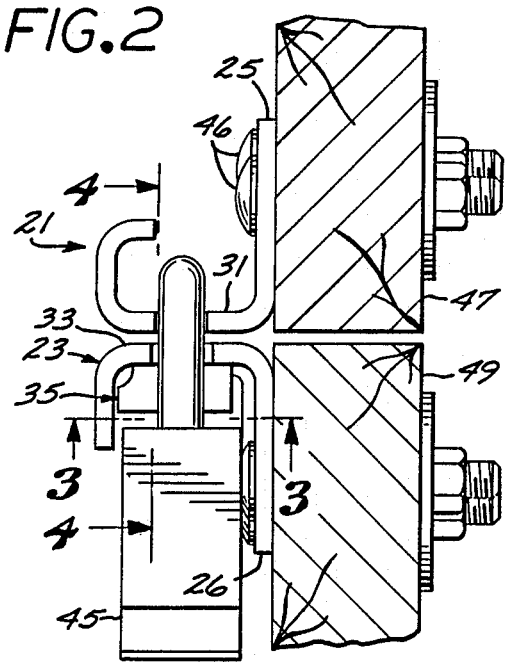
FIG. 3
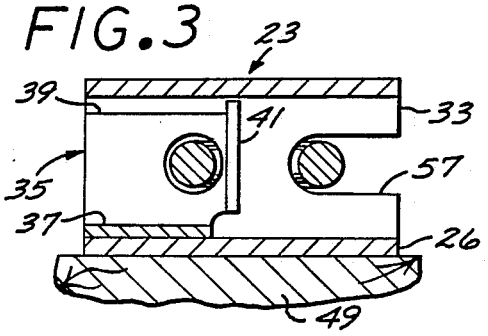
FIG. 4
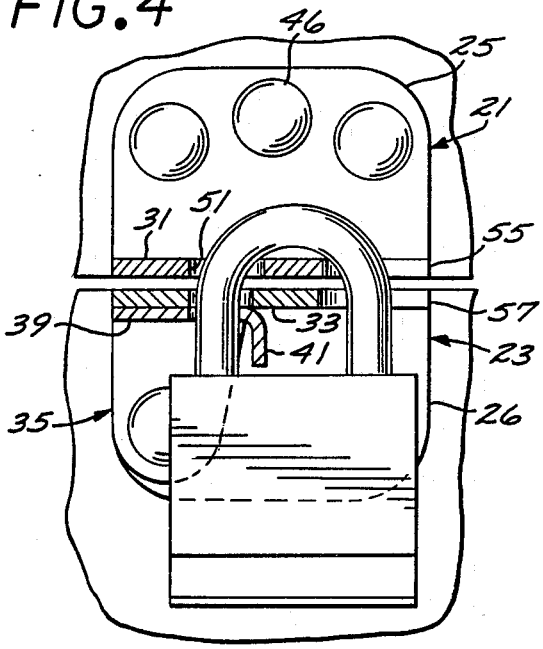
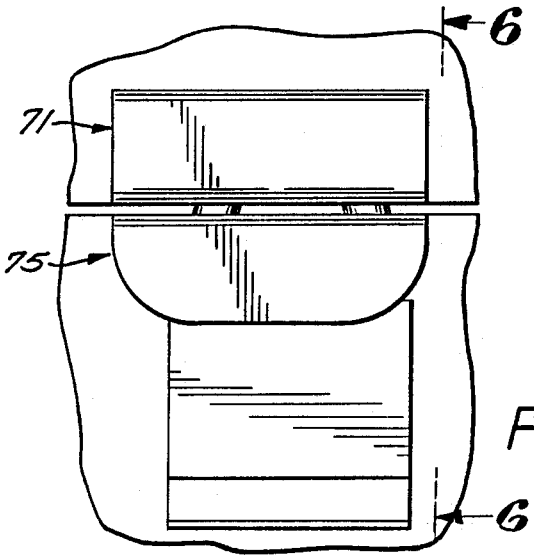
FIG. 5

PROTECTIVE PADLOCK HASP FOR USE WITH PADLOCKS HAVING MULTIPLE LENGTH SHACKLES

FIELD OF THE INVENTION

The present invention relates to hasps designed to restrict access to the shackle of a padlock locking the hasp parts together.

DESCRIPTION OF THE PRIOR ART

Padlocks have typically been utilized to lock separable parts together and have, over the years, been designed with increasingly ruggedized and robust parts to afford greater protection from an unauthorized intruder. In recognition of the fact that even these ruggedized padlocks leave the padlock shackle vulnerable to access by an intruder's tools of the trade (such as crowbars, hefty screwdrivers and bolt cutters) efforts have been made to restrict access to both the padlock body and to the padlock shackle to thus discourage such intruders.

A prior device proposed for restricting access to a padlock body is disclosed in U.S. Pat. No. 4,576,022 issued to Gamble. The Gamble device, while acceptable for restricting access to the padlock body, suffers the shortcoming that it leaves the padlock shackle totally exposed for access thereto by bolt cutters and the like.

In effort to shield the padlock hasp from access by an unauthorized tool, it has been proposed to provide hasp parts configured to restrict direct access thereto. Such a device is shown in Australian Patent Abridgement No. 549,021. Devices of this type suffer the shortcoming that they fail to fully shield the hasp and leave a gap between the hasp parts which may be easily penetrated by the tip of a large screwdriver or the like for prying of the parts apart so access may be had to such hasp through the widened gap.

Other efforts have led to the development of padlock fixtures which incorporate shield plates projecting coextensive with the padlock shackle. Such devices typically incorporate an L-shaped planar shield formed with one leg overlying the top of the padlock body and the second shield in a second leg projecting coextensive with the shackle. One such device is shown in U.S. Pat. No. 4,238,941 to Halopoff. This arrangement, while affording some restriction to access, leaves accessible space between the shield and padlock. Furthermore, it is configured such that it will only accommodate padlocks having limited design configurations. One embodiment, while incorporating oppositely opening slots for receipt of the opposite legs of the shackle to afford some flexibility in accommodating different shackle configurations, continues to suffer the shortcoming that the portion thereof embracing the padlock body has a fixed height thus limiting its effectiveness to a single padlock body configuration.

Further efforts to solve the problem of accessibility to the padlock shackle and of limiting exposure of the shackle to tampering tools has led to the development of protective hasps which incorporate stops to limit vertical travel of the shackle legs within the hasp parts to thus restrict the closed end of the shackle from exposure above a shield plate. One such device is shown in U.S. Pat. No. 4,745,783 to Poe and licensed to the assignee of the present application. This device incorporates hasp parts, one of which are formed with a web having a dimple formed therein to thus add greater depth to the hasp portion received between the shackle legs to thereby limit movement of the padlock relative to the hasp. This protective hasp, while being fully suitable for its intended purpose, suffers the shortcoming that it is only adaptable for use with a limited configuration of padlocks in that padlocks with longer shackle legs will in some instances allow the closed end of the shackle to be exposed above the shield plate. Thus, to service the broad range of padlock models embodying different configurations presently on the market, the retailer is forced to stock a wide range of hasp sizes and configurations.

Other efforts to solve this problem have included the provision of an integral stop for abutting the top of the padlock body at one end thereof to thus limit vertical movement. A device of this type is shown in U.S. Pat. No. 4,788,836 to Poe and likewise licensed to the assignee of the present application. This device, while affording even greater adaptability, again suffers the shortcoming that it does not have universal application to padlocks with different shackle configurations and lengths.

SUMMARY OF THE INVENTION

The present invention is characterized by a pair of padlock hasp parts formed with one or more mounting plates, a shield plate depended therefrom by a connecting web formed with holes for the legs of the padlock shackle and wherein a separate spacer device is provided with a mounting hole or holes which complements the hole pattern in the mounting plate or plates and is itself configured to nest against the web upon being mounted in overlying relationship on such plate or plates.

Other objects and features of the invention will become apparent from consideration of the following description taken in connection with the accompanying drawings.

BRIEF DESCRIPTION OF THE DRAWINGS

FIG. 1 is a front view of a padlock hasp apparatus embodying the present invention;

FIG. 2 is a vertical sectional view taken along the line 2—2 of FIG. 1;

FIG. 3 is a horizontal sectional view taken along the lines 3—3 of FIG. 2;

FIG. 4 is a vertical sectional view taken along the line 4—4 of FIG. 2;

FIG. 5 is a front view of a second embodiment of the padlock hasp apparatus of the present invention;

DESCRIPTION OF THE PREFERRED EMBODIMENTS

Figure 15:
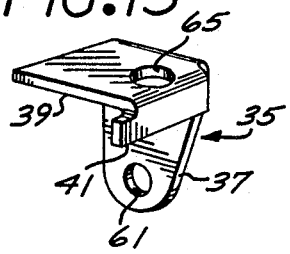
FIGS. 15–18 are perspective views of spacer devices incorporated in the respective padlock hasp apparatus shown in FIGS. 1, 6, 10 and 13.
Figure 16:
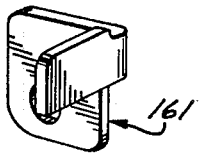

Referring to FIGS. 1–4, the padlock hasp apparatus of the present invention may incorporate hasp parts, generally designated 21 and 23 as shown in U.S. Pat. No. 4,745,783. The hasp parts 21 and 23 are generally J-shaped in vertical end view (FIG. 2) and are formed in the long legs thereof with respective planar mounting plates 25 and 26 and then being turned outwardly to form respective intermediate webs 31 and 33 and finally turning away from one another to form respective shield plates 24 and 28. Referring to FIGS. 3 and 15, a spacer device, generally designated 35, is provided with a mounting flange 37 which overlies the mounting plate 26, such device further being formed with a perpendicularly extent 39 formed on one end with a down turned spacer leg 41 for abutting the top of the padlock body 45 as shown in FIG. 4. This serves to maintain the padlock spaced downwardly relative to the shackle to thus prevent the padlock itself being bodily raised upwardly to a point where the closed end of the shackle might clear the shield plate 25 so that access could be had thereto by a bolt cutter or the like.

The mounting plates 25 and 26 of the hasp parts 21 and 23 are formed with respective bolt hole patterns for receipt of the heads and shoulders of respective carriage bolts 46 such that the bolts may be inserted as shown in FIG. 2 with the fastener nuts concealed on the interior of the relatively movable parts 47 and 49 fastened together thereby. The intermediate webs 31 and 33 are formed with respective confronting shackle-receiving holes 51 and 53 (FIG. 4) and respective confronting open ended slots 55 and 57.

The spacer device 15 is configured with the triangularly shaped downwardly projecting mounting flange 37 rounded at its bottom end and formed with a mounting bore 61 which, when the horizontal extent 39 is nested under the intermediate web 33, will align with one of the mounting openings for one of such mounting bolts 45 to thereby enable such spacer device to be mounted from the same mounting bolt 45 as the mounting plate 26. The horizontal extent 39 is formed with a through bore 65 which, when the mounting bore 61 is aligned with the appropriate mounting bolt 46, is itself in alignment with the shackle bore 53 of the lower intermediate web 33 to thus enable the shackle leg to pass therethrough.

In practice, it will be appreciated that the hasp apparatus of the present invention will be marketed in a package typically including the mounting bolts 46 and several different spacer devices 35, each having a different length spacer leg 41. Accordingly, the purchaser may then select the particular spacer 35 having the spacer leg 41 of the desired length to accommodate the length of a particular shackle incorporated in the padlock to be utilized with the hasp. In this manner, it can be assured that the spacer leg 41 is of sufficient length to positively block upward travel of the padlock body 45 relative to the hasp parts when in the locked position shown in FIGS. 2 and 4 to thereby prevent exposure of the shackle above the upper extent of the shield plate 24. This then affords the consumer the convenience and economy of adapting the hasp apparatus to a wide variety of padlock configurations, irrespective of the length of shackle projecting from the padlock body 45.

The hasp apparatus shown in FIGS. 5–8 is similar to that shown in FIGS. 1–4 except that the hasp parts, generally designated 71 and 75, are formed with respective intermediate webs 77 and 79 which are integral with and act as planar extensions of the respective mounting plates 81 and 83.

Figure 8:
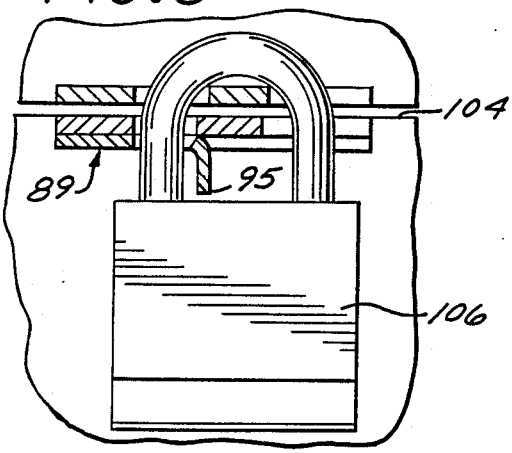
FIG. 8 is a vertical sectional view taken along the lines 8—8 of FIG. 6.
Figure 17:
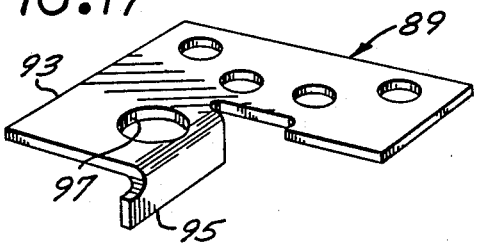

The spacer device, generally designated 89, employed with this apparatus is generally planar and incorporates a mounting plate 90 formed with a pattern of bolt receiving openings 91 (FIGS. 7 and 17) which complement the pattern of bolt holes incorporated in the mounting plate 83. The device 89 is formed with an integral extension plate 93 projecting laterally from the mounting plate 90 to be disposed in underlying relationship beneath the web 79, such extension 93 being turned downwardly at one extremity to form a spacer leg 95 configured to abut the top surface of the padlock body 45. The projection 93 is formed with a shackle receiving opening 97 which is configured and arranged to be disposed in alignment with a shackle receiving bores 101 and 103 formed in the respective webs 77 and 79 for receipt of one leg of the shackle as shown in FIG. 8. Thus, the spacer device 89 may be mounted with the mounting plate 90 sandwiched between such plate and the edge of the part 104 to thus be retained in position by the mounting screws 91 to hold the spacer leg 95 in blocking position over the top of the body of the padlock 106 (FIG. 8) to block upward travel thereof to thus prevent extension of the shackle above the top edge of the shield plate.

As noted above, the hasp apparatus of FIG. 5 will be packaged with a number of spacers 89, each having different length spacer legs 95 such that the apparatus may be readily adapted to padlock shackles of different configurations and lengths.

Figure 9:
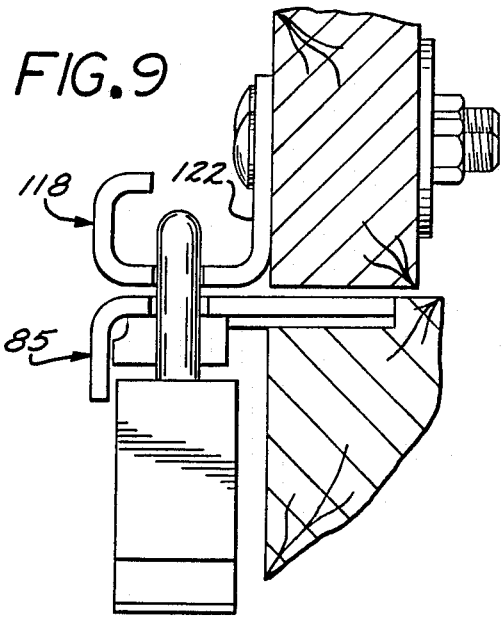
FIG. 9 is a vertical sectional view of a modification of the padlock hasp shown in FIG. 8.

The modification of the hasp apparatus shown in FIG. 9 is of the same construction as that of the apparatus shown in FIG. 8 except that the upper hasp part, generally designated 118, is generally J-shaped to form a vertical leg defining a mounting plate 122.

Figure 10:
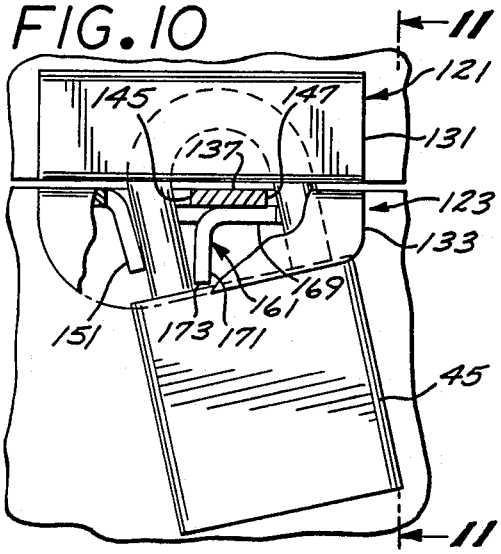
FIG. 10 is a front view, partially broken away, of a third embodiment of the padlock hasp apparatus of the present invention.
Figure 11:
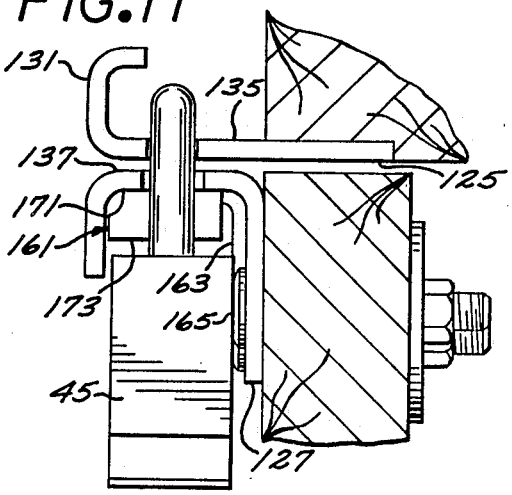
FIG. 11 is a vertical sectional view taken along the line 11—11 of FIG. 10.

The hasp apparatus shown in FIGS. 10–11 incorporates hasp parts, generally designed 121 and 123, incorporating respective mounting plates 125 and 127 carrying respective shield plates 131 and 133 from respective intermediate webs 135 and 137. As above, the webs 135 and 137 are formed with respective shackle receiving openings 145 and slots 147. Referring to FIG. 10, the lower web 137 is formed at one end with a down turned spacer tab 151 which is configured to abut the body 145 of a padlock to limit upward travel thereof. Included for use with the hasp apparatus of FIGS. 10–11, there is a spacer device 161 having a down turned mounting flange 163 formed with an opening for receipt of a mounting bolt 165 and formed with an out turned lateral extent 169 which is turned downwardly at one end to form a spacer leg 171 which terminates in a lower edge 173 to maintain the body 45 of the padlock spaced a greater distance away from the web 137 than would be the case for the integral stop 151.

Figure 6:
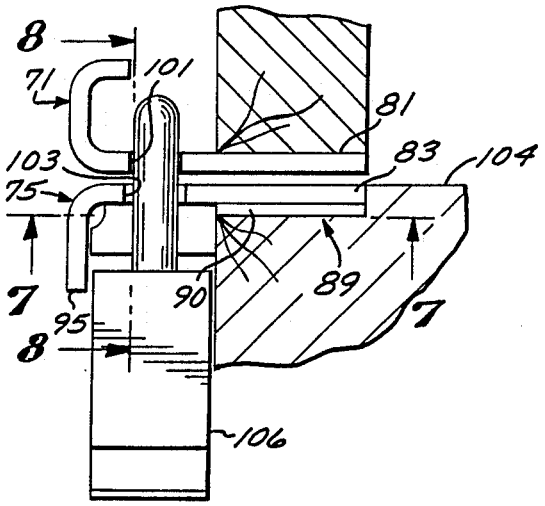
FIG. 6 vertical sectional view taken along the line 6—6 of FIG. 5.
Figure 7:
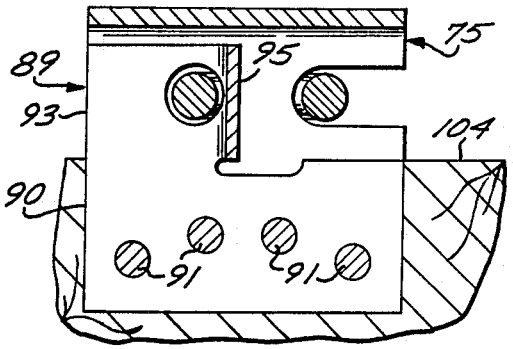
FIG. 7 is a horizontal sectional view taken along the line 7—7 of FIG. 6.
Figure 12:
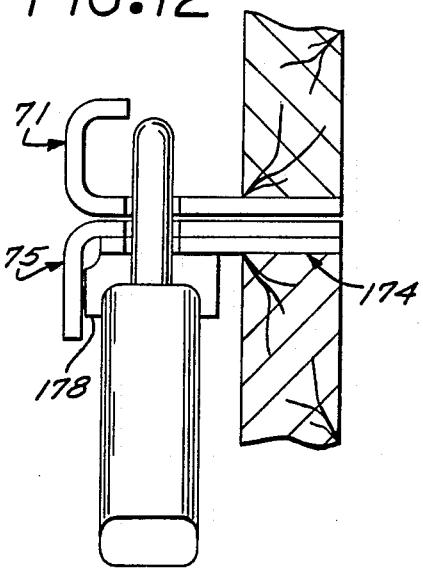
FIG. 12 is a vertical sectional view of a fourth embodiment of the padlock hasp apparatus of the present invention.
Figure 13:
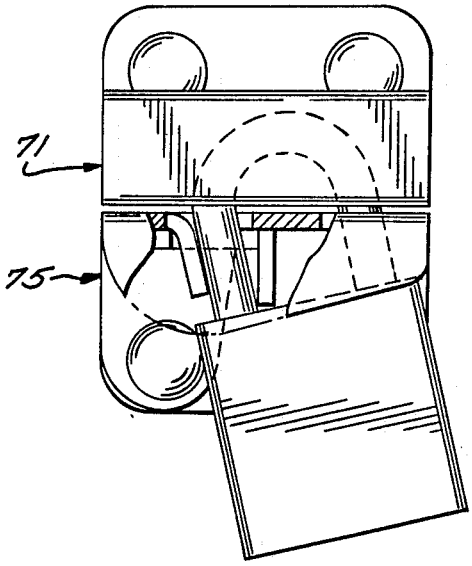
FIG. 13 is a front view, partially broken away, of a modification of the padlock hasp apparatus shown in FIG. 12.
Figure 18:
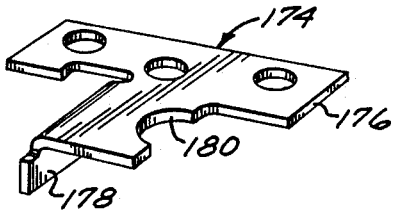

The hasp apparatus shown in FIGS. 12 and 13 is of substantially the same construction as that shown in FIG. 6, except that it incorporates a spacer device, generally designated 174 of the type shown in FIG. 18. The space 174 is formed with a mounting plate 176 formed integral with a central laterally projecting tang turned down on one end to form a spacer leg 178 and formed on its opposite end with a clearance hole 180.

Figure 14:
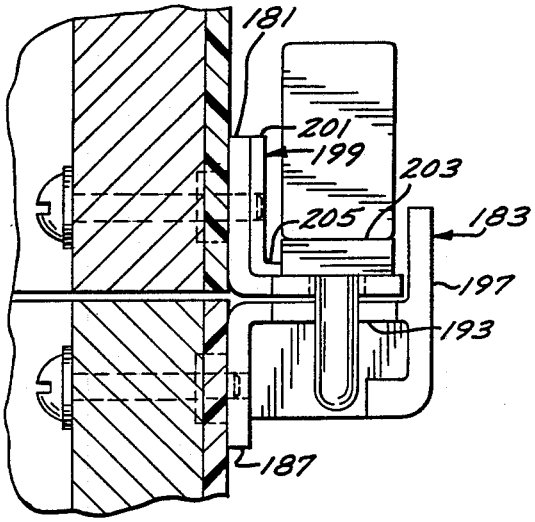
FIG. 14 is a vertical sectional view of a fifth embodiment of the padlock hasp, apparatus of the present invention.

Referring to FIG. 14, the hasp apparatus shown includes bottom and top hasp parts, generally designated 181 and 183, each having respective mounting plates 185 and 187, and webs 191 and 193 of the type disclosed in U.S. Pat. No. 4,745,783. The bottom web 193 carries at its distal end a box-like construction, the front wall of which defines a shield plate 197. Nested over the top web 191 is a spacer device, generally designated 199, which is formed with a mounting flange 201, horizontal extent 205 and upturned spacer leg 203.

Thus, the padlock may be inserted in an upside down position as shown in FIG. 14 such that the spacer leg 205 will maintain the body 45 spaced upwardly to prevent the shackle from extending downwardly below the lower extent of the shield plate 197.

From the foregoing it will be apparent that the hasp apparatus of the present invention provides a significantly improved spacer configuration which accommodates heretofore available hasp devices to numerous different configurations of padlocks, thus eliminating the necessity of stocking multiple different hasp devices for each different range of padlock construction. The spacer devices are relatively inexpensive to manufacture so multiple spacers may be packaged with the various hasp devices and the one desired for mounting thereof selected, the remaining spacers being discarded.

Various modifications and changes may be made with regard to the foregoing detailed description without departing from the spirit of the invention.

I claim:

1. A protective padlock hasp apparatus for receipt of a range of padlocks having different length shackles and comprising;

a pair of hasp mounting plates for mounting on adjacent parts and including fastener-receiving openings;

shield plate means arranged to be spaced from said mounting plate to cooperate therewith in forming a cavity for receipt of such padlock and projecting in one direction to block access by an authorized tool to the padlock shackle adjacent the body of the padlock and in the opposite direction to block direct access to the curved intermediate portion of such shackles;

webs carried from said mounting plates and formed with respective padlock shackle receiving openings, one of said webs carrying said shield plate means; and at least one discrete spacer device including a mounting flange configured to complementally nest over one of said hasp mounting plates, and formed with a fastener aperture complementally positioned to, when said mounting flange is nested over said mounting plate, be aligned with one of said fastener openings to receive therethrough a fastener, said spacer device further including a spacer leg configured to, when said mounting flange is nested over said mounting plate, engage the top surface of the body of a padlock received in said hasp apparatus to block movement of said body relative to said webs to thus cause such shackle and body to cooperate in constraining said webs against separation from one another.

2. A protective padlock hasp apparatus as in claim 1 wherein:

said webs are formed integral and planar with said mounting plates and wherein:

said spacer device includes a mounting plate for overlying one of said aforementioned hasp mounting plates and said device projects laterally thereof to form a stub web overlying one of such aforementioned webs and formed with a shackle-receiving opening to be disposed in alignment with one of such aforementioned shackle-receiving openings and is then formed with a laterally projecting leg defining said spacer leg.

3. A protective padlock hasp apparatus as in claim 1 wherein:

said hasp mounting plates are adapted to be both mounted in the same plane;

said webs project laterally from the respective hasp mounting plates; and said mounting flange of said spacer device is adapted to overlie one of said hasp mounting plates and said device includes a stub web projecting laterally of said mounting flange and formed with a shackle-receiving opening for alignment with one of such aforementioned shackle-receiving openings, said device further including a leg projecting laterally of said stub web to form said spacer leg.

4. A protective padlock hasp apparatus as in claim 1 wherein:

said mounting plates are adapted to be mounted in the same plane;

said webs project laterally from the respective mounting plates; and said mounting flange of said spacer device is adapted to overlie one of said hasp mounting plates, said flange terminating on one side in abutment edge configured to abut the web projecting laterally of said one mounting plate to limit movement of said device about a fastener projecting through said fastener-receiving aperture and said device further includes a leg projecting laterally of said mounting flange to form said spacer leg.

* * * * *